US005602631A

United States Patent [19]

Sakaguchi

[11] Patent Number: 5,602,631

[45] Date of Patent: Feb. 11, 1997

[54] DEVELOPING DEVICE FOR AN IMAGE FORMING APPARATUS

[75] Inventor: Yoshikazu Sakaguchi, Tokyo, Japan

[73] Assignee: NEC Corporation, Tokyo, Japan

[21] Appl. No.: 340,311

[22] Filed: Nov. 14, 1994

[30] Foreign Application Priority Data

Nov. 12, 1993 [JP] Japan ..... 5-282883

[51] Int. Cl.[6] ..... G03G 15/08

[52] U.S. Cl. ..... 399/284

[58] Field of Search ..... 355/259, 245

[56] References Cited

U.S. PATENT DOCUMENTS

| | | | |
|---|---|---|---|
| 4,395,110 | 7/1983 | Hosono et al. | 355/259 |
| 4,616,918 | 10/1986 | Kohyama et al. | 355/259 |
| 5,086,728 | 2/1992 | Kinoshita | 355/259 X |
| 5,177,537 | 1/1993 | Okano et al. | 355/259 |
| 5,187,523 | 2/1993 | Osawa | 355/259 X |
| 5,373,353 | 12/1994 | Fukasawa | 355/259 |

*Primary Examiner*—Fred L. Braun
*Attorney, Agent, or Firm*—Foley & Lardner

[57] ABSTRACT

In an electrophotographic image forming apparatus of the type using a one-component developer, i.e., toner, a developing device has a toner layer forming member for forming a thin toner layer on the surface of a toner carrier implemented as a roller. The toner layer is transferred from the toner carrier to an image carrier. The toner layer forming member is made up of a regulating member and a leveling member formed integrally with each other. The regulating member is made of stainless steel, phosphor bronze or similar resilient metal or silicone, urethane or similar rubber. The leveling member is located downstream of the regulating member with respect to the direction of rotation of the toner carrier and formed with a plurality of obliquely extending grooves on the surface thereof. The surface of the toner carrier is implemented by silicone rubber, urethane rubber or similar elastic material and has rubber hardness of 40 degrees to 40 degrees as measured by an Ascar C hardness tester and ten-point mean surface roughness Rz of less than 5 μm.

6 Claims, 2 Drawing Sheets

DEVELOPING DEVICE FOR AN IMAGE FORMING APPARATUS

BACKGROUND OF THE INVENTION

The present invention relates to a printer, copier, facsimile apparatus or similar electrophotographic image forming apparatus and, more particularly, to a developing device incorporated in such an image forming apparatus for developing a latent image electrostatically formed on an image carrier by a nonmagnetic one-component developer, i.e., toner. The one-component developer or toner is distinguished from a two-component developer which is a mixture of toner and carrier and will be simply referred to as toner hereinafter.

It has been customary with a developing device for the above application to supply toner from a toner supply member to a developing roller or similar toner carrier, form a thin toner layer on the toner carrier by a toner layer forming member, which is pressed against the toner carrier, while charging the toner by friction, and bringing the toner layer into contact with the surface of an image carrier implemented as a roller or a belt. With such a procedure, the developing device develops a latent image electrostatically formed on the image carrier so as to produce a corresponding toner image. Usually, the toner layer forming member is made of metal or silicone rubber or similar elastic material.

The prerequisite with the conventional device using the toner layer forming member is that the pressure acting between the toner carrier and the toner layer forming member be high enough to charge the toner uniformly and form a thin uniform toner layer. This brings about a problem that the toner is apt to adhere to the surface of the toner layer forming member. The amount of toner deposition on the toner carrier locally decreases in portions corresponding to the portions of the toner layer forming member to which the toner has adhered. As a result, the developed image suffers from an irregular density distribution and white stripes and other defects. Moreover, the adhesion of the toner obstructs stable charging and reduces the amount of charge. In addition, the toner is apt to fly about at the position where the toner carrier and toner layer forming member contact each other when the toner carrier is rotated, contaminating the inside of the device.

SUMMARY OF THE INVENTION

It is, therefore, an object of the present invention to provide a developing device for an image forming apparatus of the type using toner, or nonmagnetic one-component developer, which ensures a stable image having predetermined density at all times.

It is another object of the present invention to provide a developing device for an image forming apparatus of the type described which prevents toner from flying about and contaminating the inside of the device.

In accordance with the present invention, a developing device incorporated in an image forming apparatus for developing a latent image electrostatically formed on an image carrier by a nonmagnetic toner at a developing position has a toner carrier for forming a toner layer on the surface thereof, and a toner layer forming member for forming a thin toner layer on the toner carrier. The toner layer forming means is made up of a regulating member for regulating the thickness of the toner layer, and a leveling member located downstream of the regulating member with respect to the direction of rotation of the toner carrier and for guiding and leveling the toner layer toward the developing position in the circumferential direction of the toner carrier.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1A:
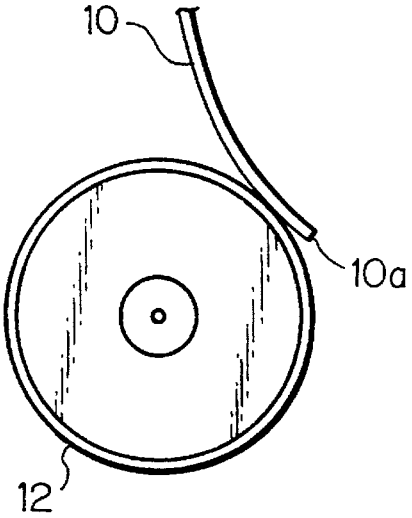
Fig. 1A PRIOR ART
FIGS. 1A and 1B are sections each showing a conventional toner layer forming member.
Figure 1B:
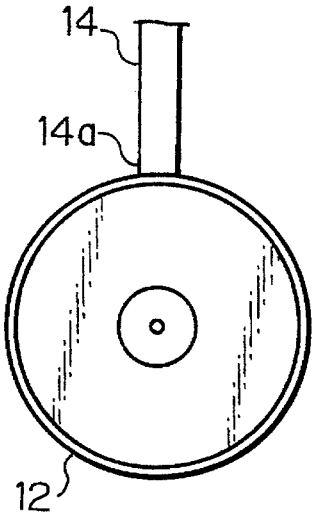
Fig. 1B PRIOR ART

To better understand the present invention, a brief reference will be made to a conventional developing device for an image forming apparatus. The conventional developing device has a toner layer forming member and a toner carrier shown in FIG. 1A or 1B by way of example. The toner layer forming member forms a thin toner layer on the surface of a developing roller or similar toner carrier in order to transfer the toner to a photoconductive belt, photoconductive drum or similar image carrier. In FIG. 1A, a toner layer forming member 10 is made of metal and contacts the surface of a toner carrier 12 at the edge 10*a* thereof. In FIG. 1B, a toner layer forming member 14 is made of silicone rubber or similar elastic material and contacts the surface of the toner carrier at the edge 14*a* thereof.

The toner layer forming member 10 or 14 has a problem that the toner adheres thereto easily, as stated earlier. This lowers the density of the resulting image and causes white stripes or similar defects to appear in the image, thereby degrading image quality. Another problem is that the toner flies about at the position where the toner carrier 12 and toner layer forming member 10 or 14 contacts each other, contaminating the inside of the device.

Figure 2:
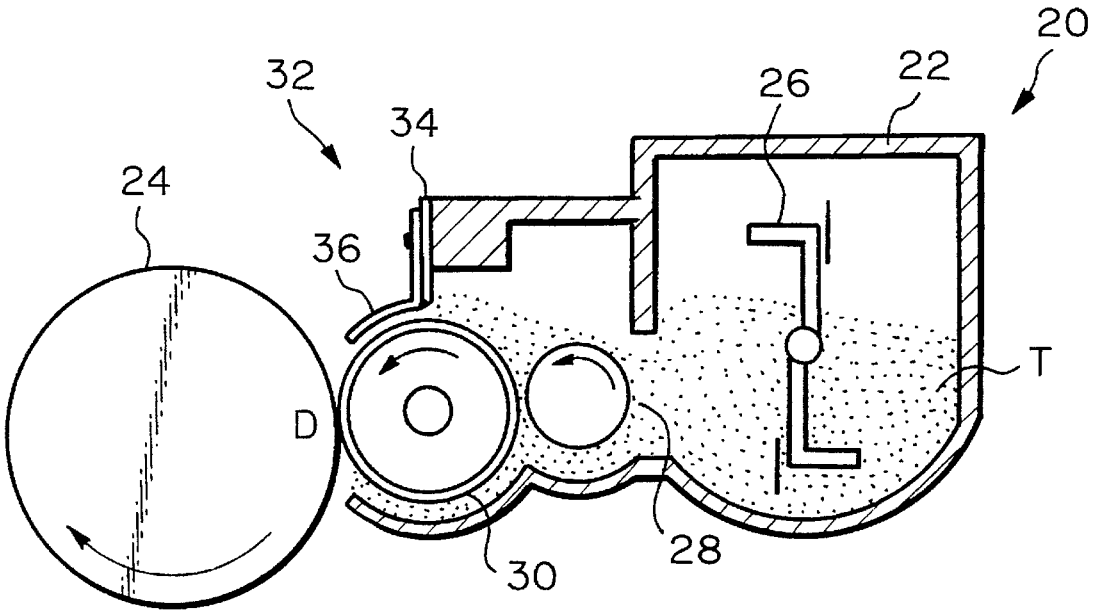
FIG. 2 is a section showing a developing device embodying the present invention.

Referring to FIG. 2, a developing device embodying the present invention is shown and generally designated by the reference numeral 20. As shown, the device 20 includes a toner hopper 22 storing toner T therein and facing an image carrier 24. In the illustrative embodiment, the image carrier 24 is implemented as a photoconductive drum. An agitator 26 is disposed in the toner hopper 22 and agitates the toner T. A toner supply member in the form of a roller 28 rotates counterclockwise, as viewed in the figure, and feeds the toner T to a toner carrier also implemented as a roller 30. The toner carrier 30, like the toner supply member 28, rotates counterclockwise. The toner carrier 30 is made up of a core made of stainless steel, aluminum or similar metal, and a surface layer covering the core and made of silicone, urethane or similar elastic material provided with conductivity. The elastic surface layer of the toner carrier 30 should preferably have rubber hardness ranging from 30 degrees to 40 degrees in Ascar C in consideration of the pressure between the toner regulating member 32 and the image carrier 24. In addition, the resistance between the surface and the axis of the roller 30 should preferably be $10^5$ Ωto $10^6$ Ω, so that a bias for development may be efficiently applied to the roller 30. Further, the toner T implemented as polyester particles has a bulk center particle size of about 7 μm. Hence, to prevent the toner T from adhering to the roller 30 and to charge the toner T uniformly, it is preferable that the ten-point mean roughness of the roller 30 be less than 5 μm. A toner layer forming member 32 is made up of a regulating member 34 and a leveling member 36.

The toner T deposited on the toner carrier 30 is charged by friction in contact with the regulating member 34 while having the thickness thereof regulated by the member 34. While the regulated toner layer is conveyed along the leveling member 36, it is further frictionally charged by the member 36. At this instant, the toner moves in the circumferential direction and axial direction of the toner carrier 30 due to the pressure being exerted by the member 36 and oblique grooves formed in the underside of the member 36. As a result, at the position where the toner carrier 30 and image carrier 24 face each other (developing position D), the toner has formed a layer uniform in the axial direction of the toner carrier 30 and has been charged uniformly and stably. At the developing position D, an electric field is generated by a difference between the surface potential of the image carrier 24 and the bias being applied to the toner carrier 30. Consequently, the toner T reaching the developing position D is transferred from the toner carrier 30 to the image carrier 24 to develop a latent image electrostatically formed on the image carrier 24.

Figure 3A:
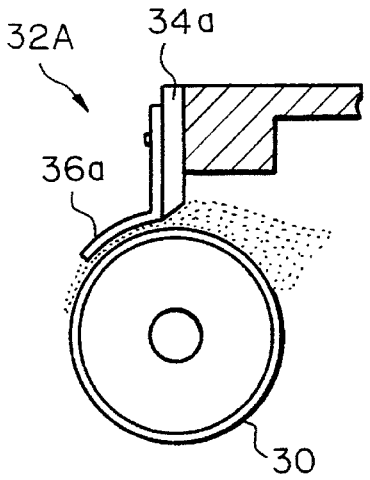
FIGS. 3A and 3B are sections each showing a specific configuration of a toner layer forming member included in the embodiment.
Figure 3B:
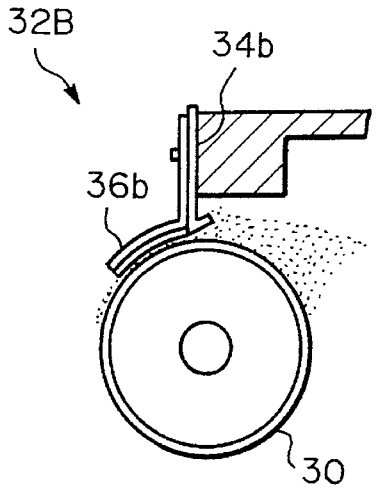

FIGS. 3A and 3B each shows a specific configuration of the toner layer forming member 32. In FIG. 3A, a toner layer forming member 32A has a regulating member 34*a* made of silicone rubber and a leveling member 36*a* made of stainless steel, phosphor bronze or similar metal. In FIG. 3B, a toner layer forming member 32B has a regulating member 34*b* made of stainless steel or similar metal and having a bent edge, and a leveling member 36*b* made of stainless steel or similar metal and covered with silicone rubber or similar elastic material.

The toner T moving away from the regulating member 34*a* or 34*b* is leveled by the leveling member 36*a* or 36*b* to form a thin uniform layer. Hence, the distance between the toner carrier 30 and the edge of the regulating member 34*a* or 34*b* can be equal to or even greater than the distance between the toner carrier 30 and the leveling member 36*a* or 36*b*. In addition, it is not necessary for the regulating member 34*a* or 34*b* to be strongly pressed against the toner carrier 30. To ensure accurate positioning, the leveling member 36*a* or 36*b* may be affixed to the regulating member 34*a* or 34*b*, or the former may be formed integrally with the latter 34*b*.

Figure 4A:
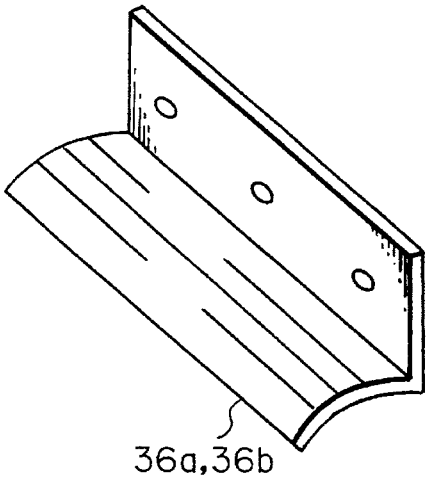
FIGS. 4A and 4B are perspective views of a leveling member included in each of the configurations shown in FIGS. 3A and 3B.
Figure 4B:
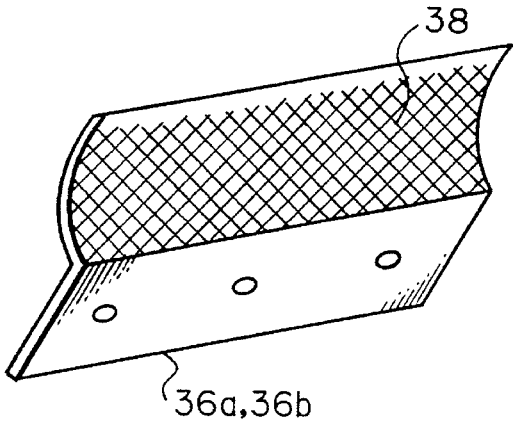

The leveling member 36*a* or 36*b* appears as shown in FIG. 4A when seen from the front or as shown in FIG. 4B when seen from the side where it contacts the toner carrier 30. As shown, the surface of the leveling member 36*a* or 36*b* contacting the toner carrier 30 is formed with a plurality of grooves 38 extending obliquely to the circumferential direction of the toner carrier 30. The toner T regulated by the member 34*a* or 34*b* is conveyed to the leveling member 36*a* or 36*b*. Then, the toner T moves obliquely to the direction in which the toner carrier rotates due to the rotation of the toner carrier and the grooves 38 of the member 36*a* or 36*b*. As a result, the toner T forms a thin uniform layer before reaching the developing position D, while being uniformly charged by the member 36*a* or 36*b*. Therefore, even when the toner T or paper dust or similar impurity adheres to the regulating member 34*a* or 34*b* to make the toner layer on the toner carrier 30 irregular in thickness, the toner layer is leveled by the leveling member 36*a* or 36*b*. This ensures attractive images by obviating a local decrease in the density of a developed image and white stripes or similar defects.

Experiments showed that the grooves 38 of the leveling member 36*a* or 36*b* should preferably not be deeper than 5 μm in respect of image quality.

In summary, the present invention provides a developing device which ensures sufficient charging of toner and a thin uniform toner layer, despite the fact that a toner layer forming member exerts only a relatively low pressure on a toner carrier. This allows a minimum of toner to adhere to the surface of a regulating member included in the toner layer forming member. Even when the toner adheres to the regulating member, a leveling member following the regulating member surely forms a thin uniform toner layer. As a result, the amount of toner deposited on the toner carrier is prevented from becoming short; otherwise, a local decrease in image quality and white stripes and other defects would occur in the resulting image. The device of the present invention is free from an occurrence that the amount of charge becomes unstable or short due to the adhesion of the toner. In addition, since the leveling member encloses the toner carrier up to a position close to a developing position, the toner scarcely flies about at the position where the toner carrier and regulating member contact and, therefore, scarcely contaminates the inside of the device.

Various modifications will become possible for those skilled in the art after receiving the teachings of the present disclosure without departing from the scope thereof.

What is claimed is:

1. A developing device and image forming apparatus for developing a latent image electrostatically formed on an image carrier by a nonmagnetic toner at a developing position, said device comprising:

an image carrier;

a rotating toner carrier with a rotating surface in contact with said image carrier at a developing position;

toner layer forming means for forming a thin toner layer on said toner carrier;

said toner layer forming means comprising:

a regulating member spaced a first distance from the rotating surface of said toner carrier for regulating a thickness of the toner layer; and a leveling member spaced a second distance from the rotating surface of said toner carrier, which second distance is equal to or less than said first distance, said leveling member located downstream of said regulating member with respect to a direction of rotation of said toner carrier for guiding and leveling the toner layer before said toner layer reaches said developing position for said toner carrier.

2. A device as claimed in claim 1, wherein said regulating member and said leveling member are formed integrally with each other.

3. A device as claimed in claim 1, wherein said regulating member is made of one of stainless steel, phosphor bronze, silicone rubber, and urethane rubber.

4. A device as claimed in claim 1, wherein said leveling member is made of one of stainless steel, phosphor bronze. and stainless steel or phosphor bronze covered with silicone rubber or urethane rubber.

5. A device as claimed in claim 1, wherein said leveling member is formed with a plurality of grooves on a surface thereof, said plurality of grooves being not deeper than 5 μm and extending obliquely to a circumferential direction of said toner carrier.

6. A device as claimed in claim 1, wherein said toner carrier is made of silicone rubber or urethane rubber having rubber hardness of 30 degrees to 40 degrees as measured by an Ascar C hardness tester and having ten-point mean surface roughness Rz less than 5 μm.

* * * * *